US006053330A

United States Patent [19]

Lavoie

[11] Patent Number: 6,053,330

[45] Date of Patent: Apr. 25, 2000

[54] ADJUSTABLE ROLLER SCREEN

[75] Inventor: Jean-Guy Lavoie, Montreal, Canada

[73] Assignee: Met-Chem Canada, Inc., Montreal, Canada

[21] Appl. No.: 09/257,118

[22] Filed: Feb. 25, 1999

[51] Int. Cl.[7] ..... B07B 13/05; B07B 1/49

[52] U.S. Cl. ..... 209/668; 209/673; 209/394

[58] Field of Search ..... 209/668, 667, 209/660, 673, 394

[56] References Cited

U.S. PATENT DOCUMENTS

| | | | |
|---|---|---|---|
| 1,651,622 | 12/1927 | Norman . | |
| 1,999,574 | 4/1935 | Paxton . | |
| 2,035,587 | 3/1936 | Brandenburg . | |
| 3,260,364 | 7/1966 | England | 209/107 |
| 4,120,363 | 10/1978 | Ernst | 171/58 |
| 4,128,282 | 12/1978 | Bost | 308/20 |
| 4,148,398 | 4/1979 | Mustikka | 209/668 |
| 4,291,808 | 9/1981 | Roloff | 209/668 |
| 4,311,242 | 1/1982 | Hnatko | 209/668 |
| 4,316,543 | 2/1982 | Leonhardt | 209/673 |
| 4,405,050 | 9/1983 | Fenton, Jr. et al. | 209/668 |
| 4,627,541 | 12/1986 | Johnson | 209/668 |
| 4,767,010 | 8/1988 | Bost | 209/670 |
| 5,060,806 | 10/1991 | Savage | 209/668 |
| 5,080,219 | 1/1992 | Imai et al. | 198/781 |
| 5,590,793 | 1/1997 | Johansson | 209/668 |
| 5,824,356 | 10/1998 | Silver et al. | 426/481 |

*Primary Examiner*—Donald P. Walsh
*Assistant Examiner*—Daniel K Schlak
*Attorney, Agent, or Firm*—William F. Riesmeyer, III

[57] ABSTRACT

A roller screen is provided with an assembly for adjusting the spacing between the rolls simultaneously. The assembly includes an elongated bar is provided adjacent one end of the rolls and has a plurality of wedges slidably mounted thereon. Bearing support plates slidably mounted in a frame have v-shape wedge portions slidably engaging adjacent side surfaces of the wedges on said bar. In a preferred embodiment a plurality of computer assisted hydraulic cams selectively move the bar upwardly and downwardly to adjust engagement of the wedges and the spacing between the rolls. Preferably a spacing adjustment assembly is provided at both of the opposite ends of the rolls in the roller screen.

12 Claims, 7 Drawing Sheets

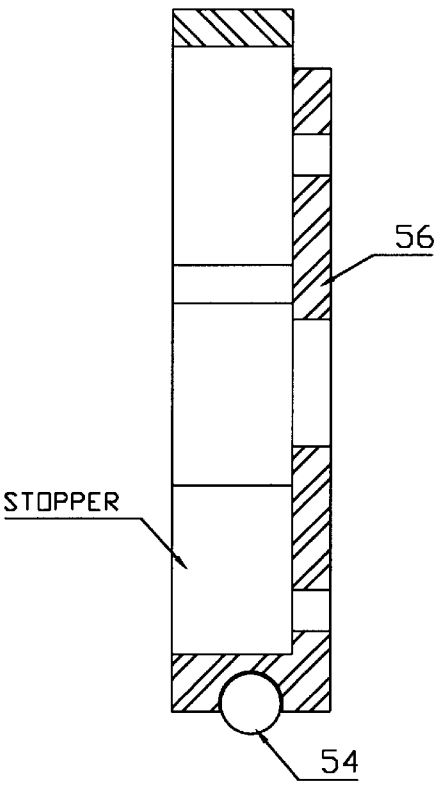
FIG. 6B
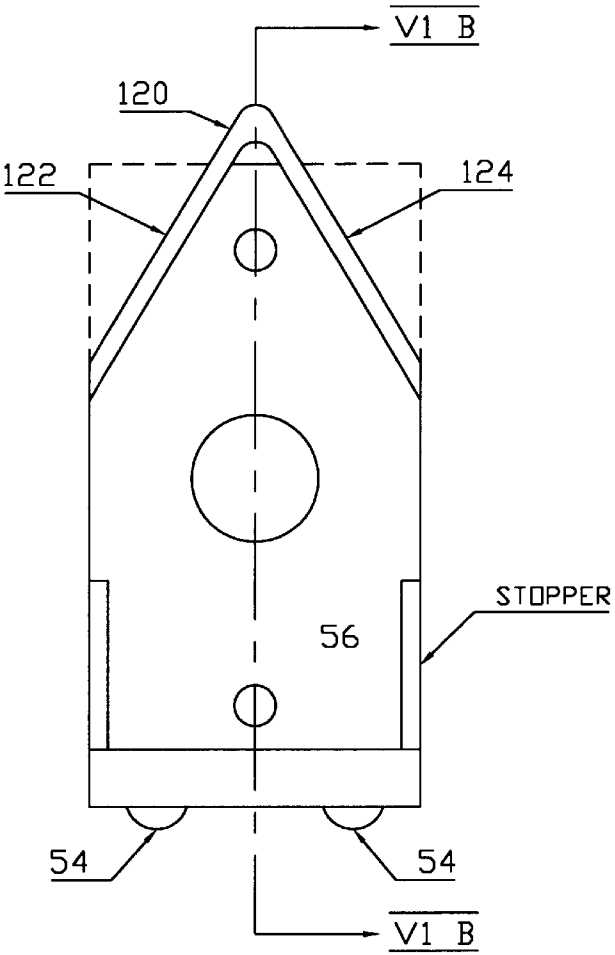
FIG. 6A
FIGURE 6

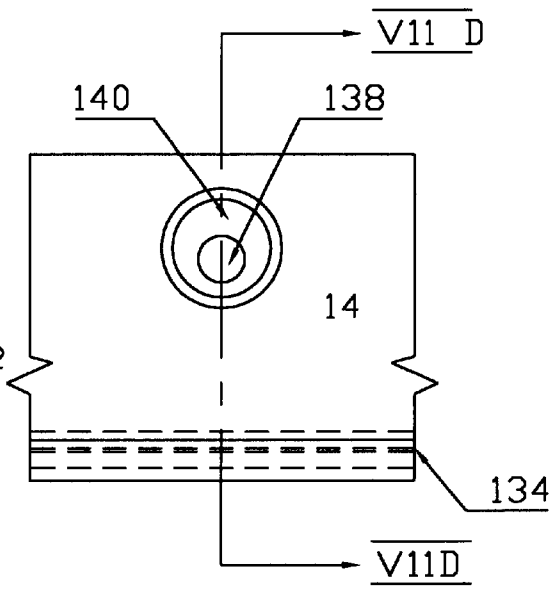
FIG. 7C
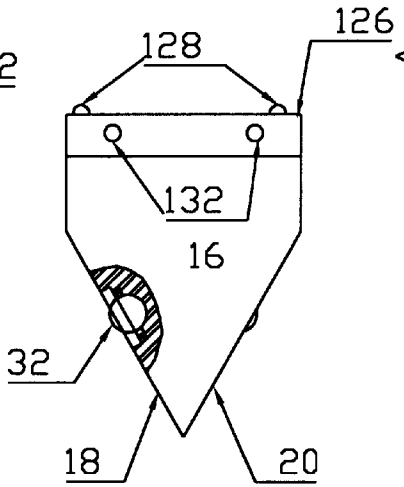
FIG. 7A
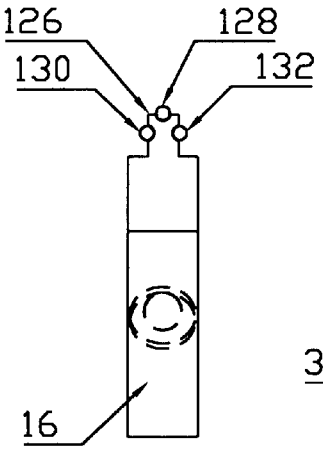
FIG. 7B
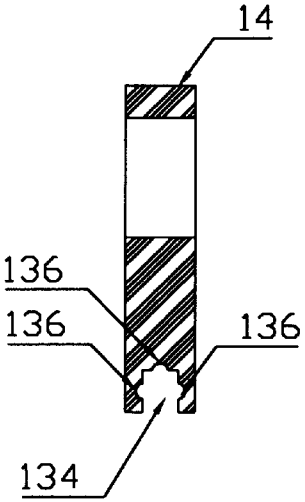
FIG. 7D
FIGURE 7

ADJUSTABLE ROLLER SCREEN

TECHNICAL BACKGROUND

This invention relates to a roller screen for separating particulate materials by size, and particularly to a roller screen having a plurality of vertically actuable wedges for automatically adjusting the spacing of the rolls in the roller screen.

BACKGROUND ART

In an iron ore pelletizing plant, finely crushed ore is rolled into "green balls" or unbaked pellets in disc-type pelletizing machines or balling drums. Heating in an indurating machine then hardens the green balls. Subsequently the hardened pellets are transported to an integrated steel plant to be used as a charging material to an iron blast furnace or for direct reduction. One of the requirements for blast furnace and direct reduction feed is that the pellets be within a proper size range, especially that the amount of fines less than 9 mm (⅜ inch) be at a minimum. Accordingly, roller screens are used to remove both fines and oversize unbaked pellets prior to indurating.

A conventional roller screen has a plurality of parallel rolls with spaces between the rolls of proper dimension for determining the size of material sieved by the roller arrangement. The rolls are rotatably driven so that particulate material is both conveyed and screened by the roller screen. A single deck screen consists of one set of parallel spaced rolls for removing undersize particulates from the material being conveyed. A double deck roller screen consists of two sets of spaced rolls generally aligned one above the other. The top set of rolls or top deck serves to remove oversize particulates and the lower deck removes undersize particulates from the material. In the processing of iron ore pellets for ultimate charging to an iron blast furnace or a direct reduction furnace the top deck is precisely spaced to remove the oversize fraction +16 mm i.e. those pellets having a dimension greater than 16 mm. The lower deck is space to remove the minus i.e. smaller than 9 mm size fraction. The oversize material is sent back to a crushing operation whereas the undersize fraction is recycled to the pelletizing machine. Roller screens have application in a number of ore processing operations and are not limited to use in the processing of iron ore.

To ensure good on-size quality of green pellets each roll in the screen has to be spaced separately. Complete gapping of top and bottom screen decks takes approximately 6 hours during which time the machine has to be shut down. The gapping task is accomplished by removing skirting plates adjacent opposite ends of the rolls, loosening sealing plates on the drive casing and driven side supports, loosening two bearing bolts located at the end of each roll, shifting the rolls to the desired gap, re-tightening the loose bolts at both ends of the rolls, re-tightening the sealing plates and re-installing the skirting plates. This is a time consuming task in roller screens that require manual adjustment of the roll spacing. Thus, substantial production time is lost while adjusting the rolls to the precise spacing required for proper separation of the material.

U.S. Pat. No. 5,590,793, to Johansson, discloses a roll screen in which the roll spacing is adjustable. In one embodiment the adjusting device acts on all rolls simultaneously so that the spacing change will be the same for all rolls. The roll axles are journaled in bearings mounted in carrier sleeves contained in housings at opposite ends of each roll. A carrier wheel journaled on each carrier sleeve has an angled arm with a runner wheel at an opposite end of the arm. Two parallel tracks are provided in which the distance between the tracks can be varied by a wedge arrangement. The carrier wheels ride on the upper track and the runner wheels ride on the lower track. When the distance between the tracks is adjusted the carrier housings and the rolls rotate changing the spacing between the rolls. In another embodiment the spacing between adjacent pairs of rolls may be individually adjusted. A wedge-shaped spacer is mounted between the housings of adjacent rolls and is movable by an adjuster screw. A linear ball bearing device facilitates movement of the spacer means. A precompressed elastic sealing element is provided to seal against an outer drive casing. Individual seal elements for each roll also seal against each other as the spacing between rolls is adjusted. The reference does not disclose or suggest a roller screen having an elongated bar with a plurality of wedges slidably mounted thereon with each wedge coacting with a wedge portion on each roll bearing support plate when the bar is moved to simultaneously adjust the spacing between the rolls. By comparison the reference apparatus is relatively complex and expensive to build.

U.S. Pat. No. 4,627,541, to Johnson, discloses a roller conveyor for sorting produce which includes an apparatus for hydraulically adjusting the space between the rolls. The ends of each roll are supported in a bearing block which has grooves to allow slidable movement in tracks in a frame. A slidable connecting rod is attached between the bearing blocks of adjacent rolls. The spacing between rolls is hydraulically controlled by a series of hydraulic cylinders which selectively inject hydraulic fluid into the bearing blocks so as to cause the connecting rods to slide the rolls further apart. Alternatively hydraulic fluid is expelled from the bearing blocks so as to drive the slidable connecting rods closer together and to move the rolls closer together. The present invention does not involve the injection of hydraulic fluid into bearing blocks to adjust the spacing between rolls.

U.S. Pat. No. 1,999,574, to Paxton, discloses a device for sizing fresh fruit. Cams control the spacing of rolls in the device. Rotation of the cams causes vertical arms from which the rolls depend downwardly to move toward or away from each other to adjust the spacing of the rolls. The reference does not disclose or suggest a cam mechanism for controlling upward and downward movement of an elongated bar to control slidable movement of wedges slidably mounted on the bar as they coact with wedges mounted on bearing support plates of rolls in a roller screen.

U.S. Pat. No. 4,405,050, to Fenton, et al, discloses a roll screen in which adjustment of the spacing between rolls is accomplished by a threaded adjusting bolt having oppositely threaded ends engaging support blocks in which adjacent rolls are mounted. The support blocks have grooves along their top and bottom surfaces which are slidably mounted in rail attached to a frame. Rotation of the adjusting bolt in one direction increases the spacing between rolls while rotation in the opposite direction decreases the roll spacing.

U.S. Pat. No. 4,148,398, to Mustikka, discloses a roll screen for screening pellets to be sintered. The spacing between rolls is adjusted by a piston which actuates a lever arm connected to a vertical support which is suspended from a bearing at its upper end with a roll mounted at its lower end. Adjacent rolls are attached to the lower ends of similarly suspended vertical supports. Intermediate arms connect the vertical supports of adjacent rolls to control the movement of the rolls upon actuation of the lever arm.

U.S. Pat. No. 5,060,806, to Savage, discloses a roll separating apparatus in which the rolls are connected by an accordion-type linkage. The spacing between rolls is adjusted by rotation of an elongated screw element that will cause movement of the block of the endmost roll, thus causing corresponding movement the other adjacent rolls.

U.S. Pat. No. 4,291,808, to Roloff, discloses a roll conveyor in which shims are used to adjust the roll spacing.

The above references do not singly or in combination disclose or suggest a roller screen having an elongated bar having a plurality of wedges slidably mounted thereon which coact with wedges mounted on roll bearing support plates of a roller screen for adjusting the spacing between the rolls.

Other miscellaneous patent references are: U.S. Pat. Nos. 1,651,622; 2,035,587; 3,260,364; 4,120,363; 4,128,282; 4,311,242; 4,316,543; 4,767,010; 5,080,219; and 5,824,356.

DISCLOSURE OF INVENTION

This invention is of a roller screen conveyor having an assembly for adjusting the spacing between a plurality of rolls in the conveyor simultaneously. The roller screen has a frame and a plurality of rolls rotatably mounted in the frame. The assembly includes an elongated bar extending lengthwise of the roller screen adjacent one end of the rolls. A plurality of v-shape wedges is slidably mounted on said bar along a longitudinal direction thereof. A plurality of roll bearing support means each has a v-shape wedge slidably engaging adjacent wedges on said bar. The bearing support means, which preferably comprise bearing support plates, are slidably mounted in said frame. Means are provided for selective translational movement of the bar upwardly and downwardly to adjust the spacing between the rolls by coaction of the wedges. Preferably a plurality of computer assisted hydraulically actuated cams are provided to move the bar upwardly and downwardly. In a preferred form, a fixed stop is also provided at one end of the conveyor to limit travel of the rolls at that end and a mobile stop is provided at an opposite end of the conveyor to permit slidable movement of the rolls and adjustment of the spacing between them. A computer assisted hydraulically actuated pressure lever preferably is provided to maintain the proper degree of positive pressure on the mobile stop to retain proper spacing of the rolls.

The roller screen conveyor of this invention provides for faster and more precise adjustment of the spacing between rolls than any of those previously available without equipment stoppage.

BRIEF DESCRIPTION OF THE DRAWINGS

FIG. 6A is a front view of the flange bearing mounting support for the driven side of the roller screen of FIG. 2.

FIG. 6B is a section taken at VIB—VIB of FIG. 6A.

FIG. 7A is a front view of one of the sliding wedges of FIG. 1.

FIG. 7B is an end view of the sliding wedge of FIG. 7A.

FIG. 7C is a front view of a portion of the elongated bar and the cam mechanism for upwardly and downwardly moving the bar and the wedges of FIG. 1.

FIG. 7D is a section taken at VIID—VIID of FIG. 7C.

MODES FOR CARRYING OUT THE INVENTION

Figure 1:
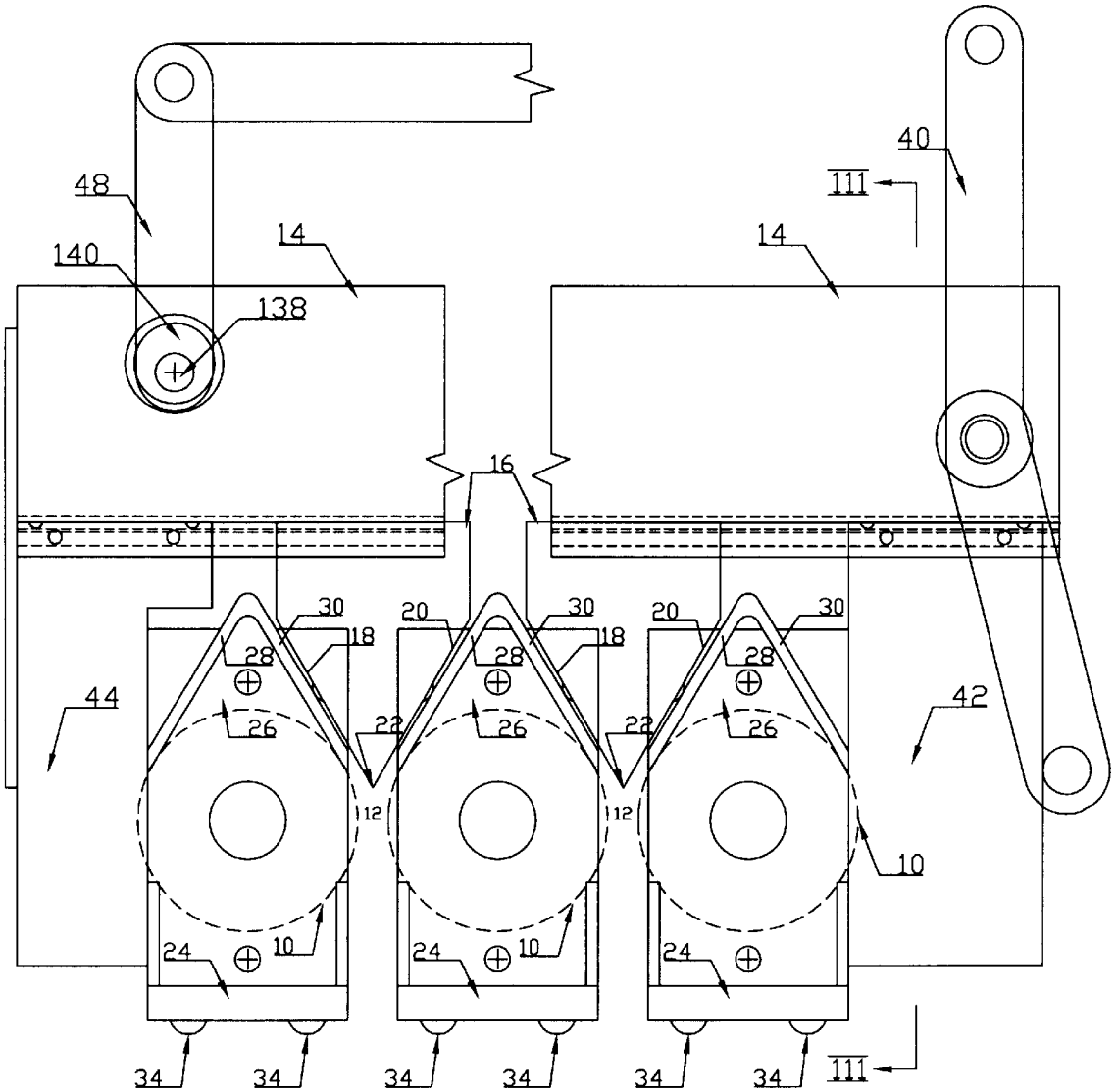
FIG. 1 is side elevation view of a roller screen according to this invention.

The roller screen of this invention is illustrated as applied to a prior art roller screen of the type shown in U.S. Pat. No. 5,287,977, the specification of which is incorporated herein by reference. Referring to FIG. 1 the roller screen of this invention includes a plurality of rolls 10 for conveying material such as ore pellets from one end to the other end of the device. The spacing 12 between the rolls is adjusted by an assembly which includes an elongated bar 14 having a plurality of v-shape wedges 16 slidably mounted therein. Each wedge has sloping side surfaces 18 and 20 forming the v-shape with apex 22 pointing in a downward vertical direction. A plurality of bearing support means 24 at opposite ends of each roll have a v-shape plate 26 with legs 28 and 30 facing the adjoining legs 18 and 20 of the wedges 16. A roller bearing 32 is provided in each side 18 and 20 of wedges 16 to ease sliding movement of the wedges against the legs 28 and 30 of each plate 26. Each support means on the drive side of the rolls has roller bearings 34 to permit slidable movement in casing 38 (FIG. 3). Each support means on the driven or idle side has roller bearings that ride on the tracks of an idle frame as more specifically described below. Pressure lever 40 maintains pressure on a slidably mobile end member 42 mounted on bar 14 adjacent the exit end of the screen to maintain the preset spacing of the rolls which is adjusted as described below. A fixed end member 44 is provided at the feed end of the conveyor to serve as a stop against which the bearing support for the endmost roll is abutted. Cams 46 (FIG. 2) are actuated by a lever arm 48 to selectively raise or lower bar 14, thus causing wedges 16 to alternately increase or decrease the spacing between the rolls by acting on plates 26 of support members 24. Computer assisted hydraulic systems (not shown) control pressure on pressure lever 40 and movement of cams 46 by lever arms 48.

Figure 2:
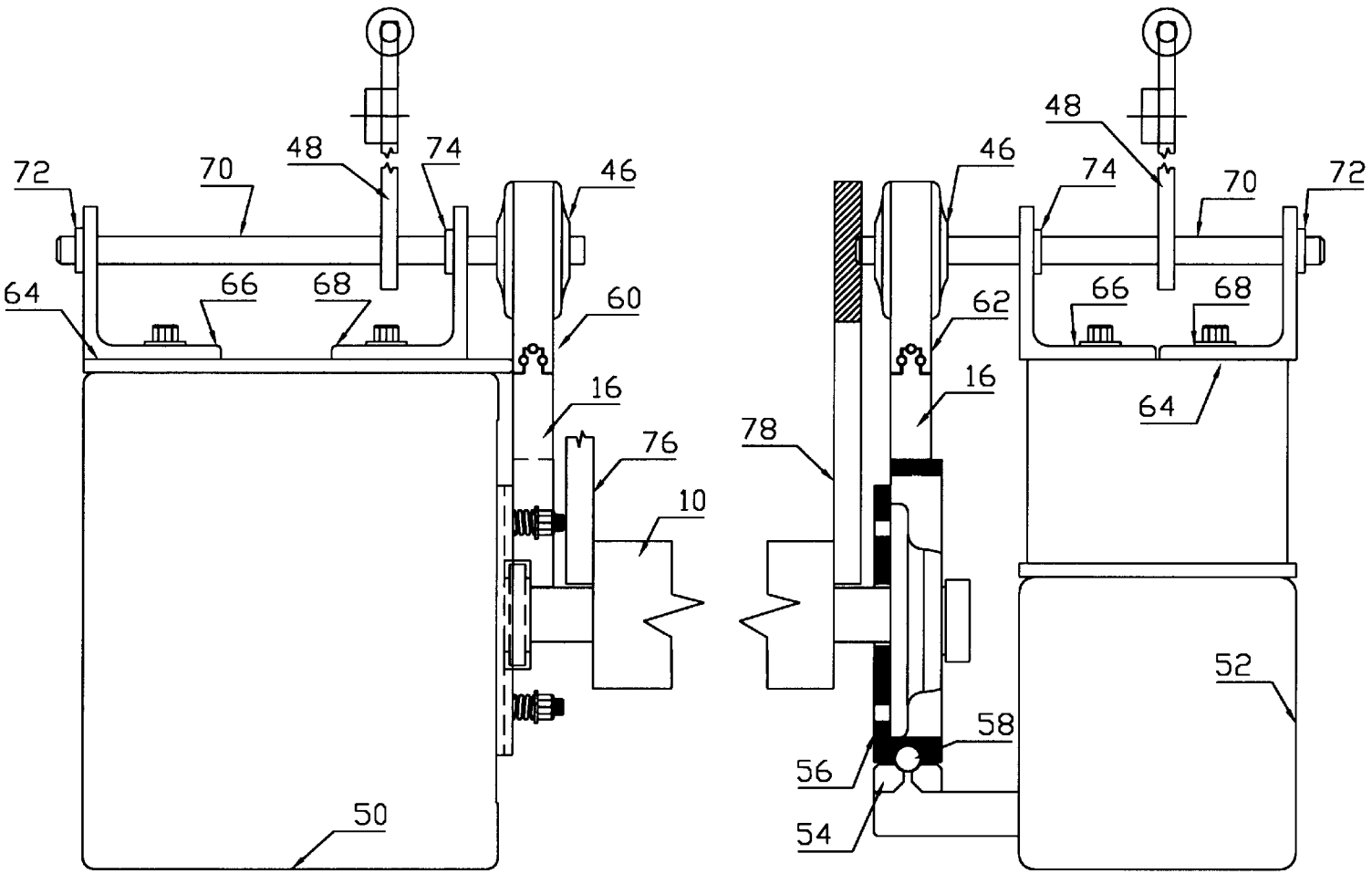
FIG. 2 is a front-end view of the roller screen of this invention.
Figure 3:
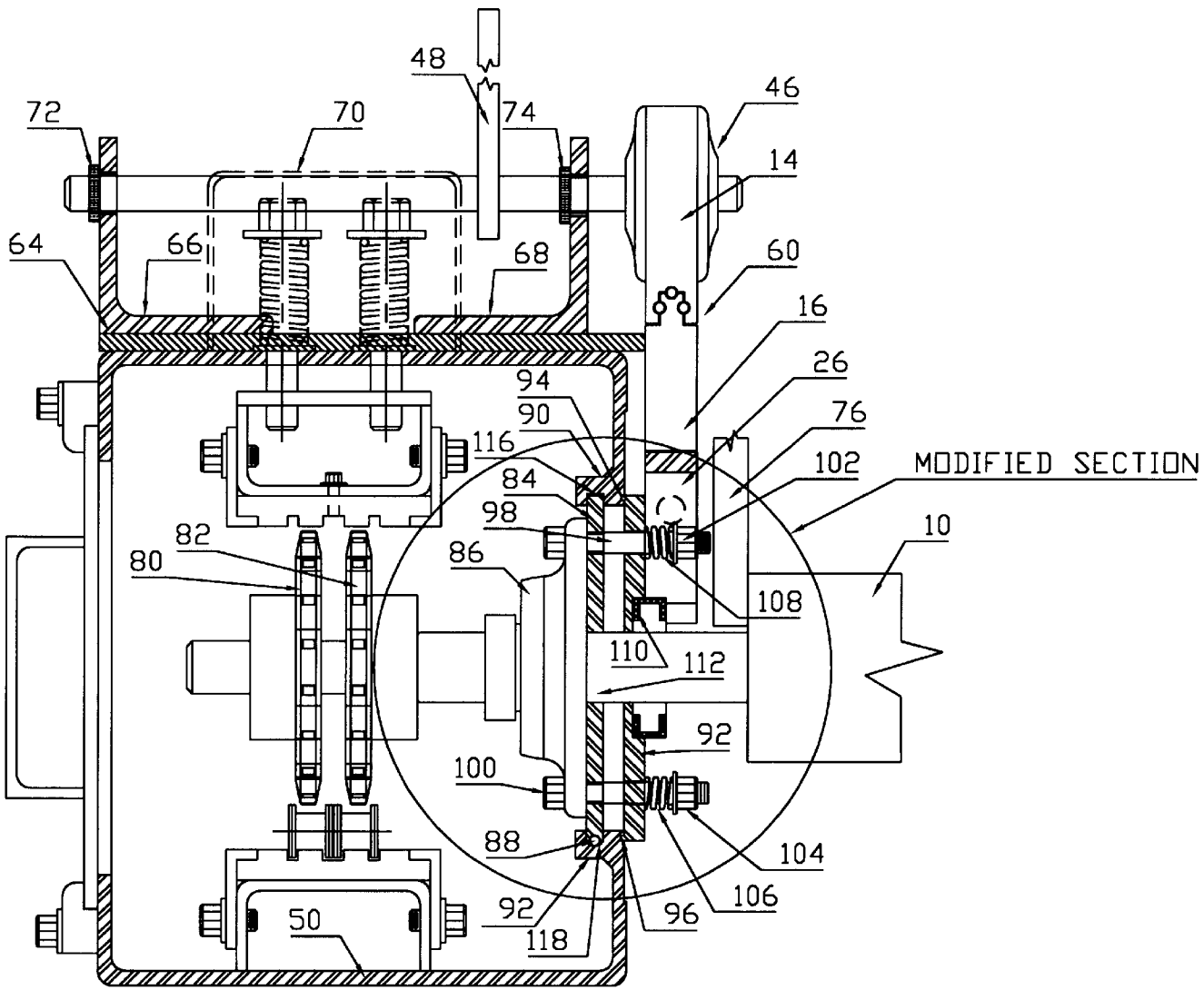
FIG. 3 is a partial cross section taken at III—III of the roller screen in FIG. 1 showing the drive side of the apparatus.

Referring to FIG. 2, the roller screen has a drive casing 50 housing a drive mechanism further shown in FIG. 3 for rotatably driving rolls 10. On the driven or idle side, idle frame 52 has frame rail 54 for guiding slidable movement of bearing support member 56 on a pair of bearings, one of which is shown at 58 riding in the frame rail. Similar spacing adjustment assemblies 60 and 62 are preferably provided on both the drive and idle side of the roller screen. Each assembly includes a cam frame 64 comprising angle plates 66 and 68 with rod 70 fastened by bushings 72 and 74. Lever 40 turns rod 70 and rotates cam 46. Wedges 16 are moved upwardly and downwardly by bar 14 when cam 42 is rotated. Skirting plates 76 and 78 are provided to contain material on the rolls of the roller screen.

FIG. 3 shows the drive side of the roller screen in more detail. The drive mechanism itself is conventional and in one form includes chains mounted on sprockets 80 and 82. It is known in the art that a small shaft mounted gear motor may individually drive each roll. On the drive side, the bearing support means includes a bearing support plate 84 which has a pair, or a plurality, of roller bearings one of which is shown at 88 for riding in a slotted track of flange 90 of drive casing 50. The bearing support means on the drive side also includes a seal plate 92 that has projections 94 and 96 slidably mounted in upper and lower slots of casing 50. The projections and slots in casing 50 are conventional in a prior art roller screen. However, according to this invention, seal plate 92 has wedge plate 26 with legs 28 and 30 (FIG. 4A) facing upwardly to engage downwardly facing legs 18 and 20 of wedge 16 (FIG. 7A). Bearing 86 is secured to bearing support plate 84 and seal plate 92 by bolts 98 and 100 with nuts 102 and 104 compressing tension springs 106 and 108 to press the plates toward each other. Shaft seal 110 mounted on axle 112 of roll 10 keeps dirt from entering drive-casing 50.

Figure 4:
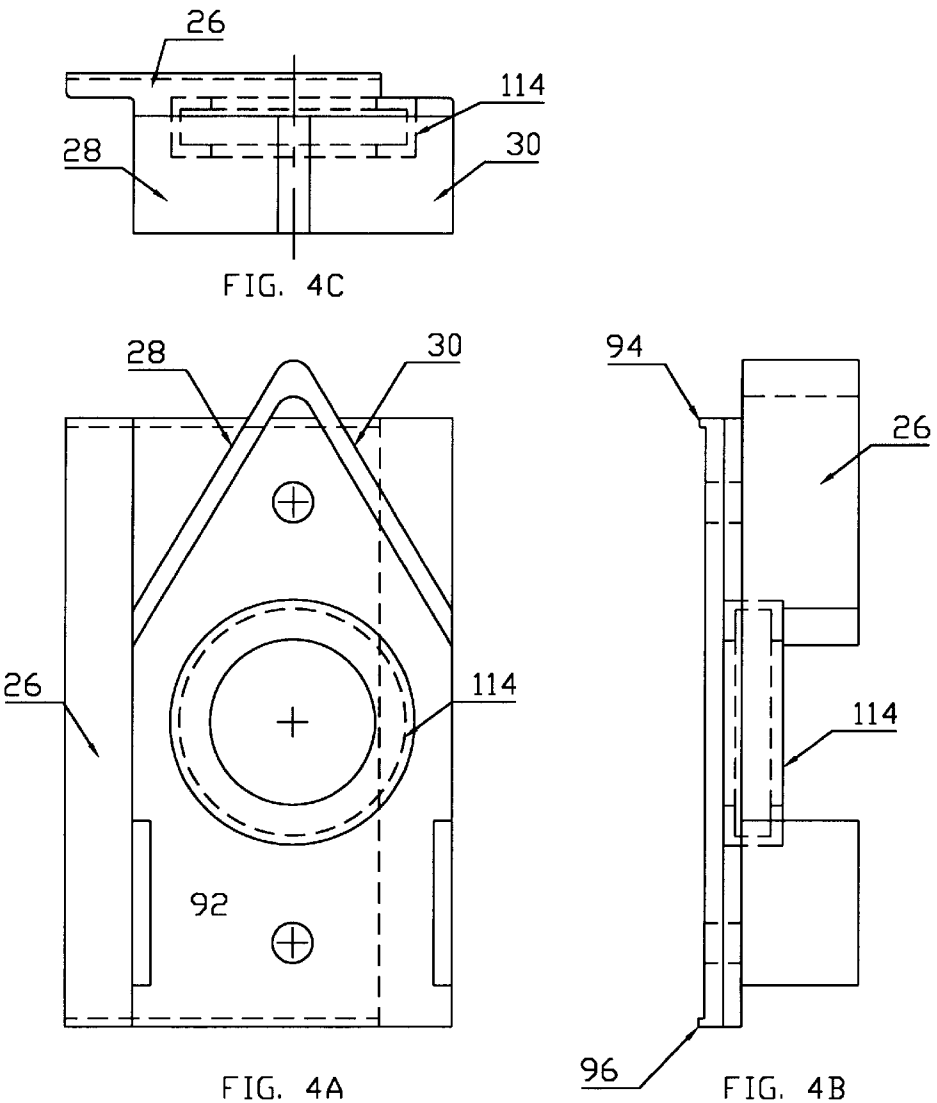
FIG. 4A is a front view of the casing seal plate of the drive side of the roller screen of FIG. 3.
FIG. 4B is an end view of the casing seal plate of FIG. 4A.
FIG. 4C is a top plan view of the casing seal plate of FIG. 4A.
Figures 5, 5A, 5B:
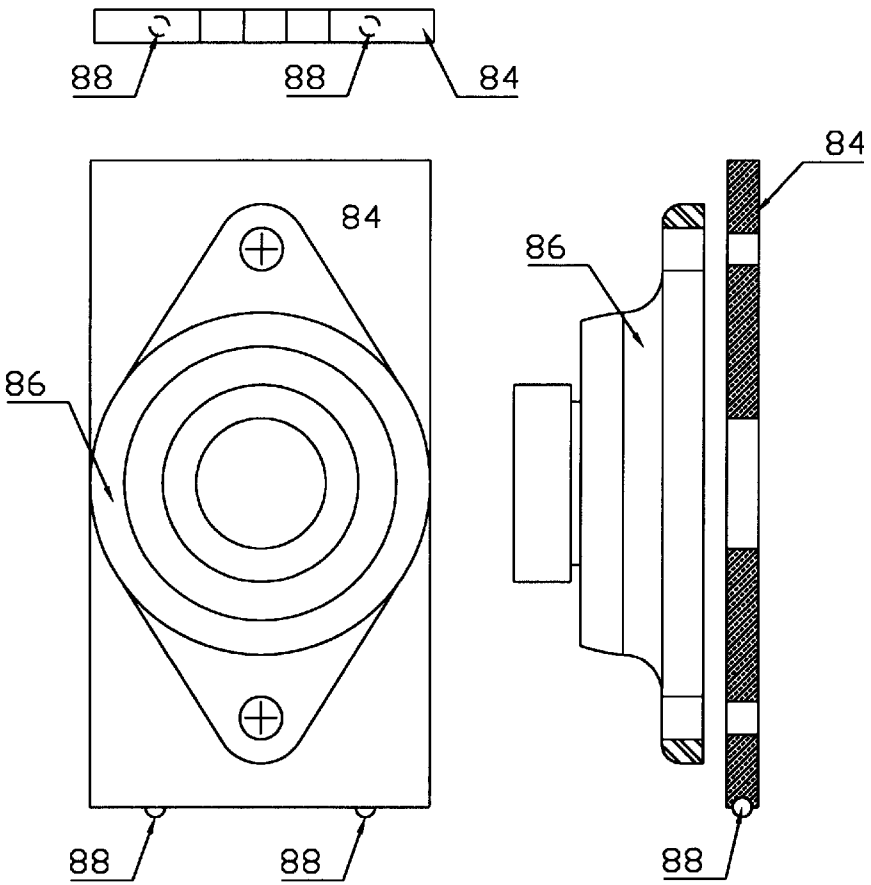
FIG. 5A is a front view of the inside flange bearing plate and bearing for the drive side of the roller screen of FIG. 3.
FIG. 5B is an end view of the inside flange bearing plate and bearing of FIG. 5A.

Sealing plate 92 for the drive side is shown in enlarged views in FIGS. 4A, 4B and 4C. Cylindrical casing 114 is provided for receiving a shaft seal (not shown). Wedge plate 26 has legs 28 and 30 facing upwardly above the cylindrical casing 114. Projections 94 and 96 ride in a slot in drive casing 50 as previously described. FIGS. 5A arid 5B show enlarged views of bearing support plate 84. Bearing 86 is adapted to be secured to plate 84 by bolts 98 and 100 and nuts 102 and 104 as described above with reference to FIG. 3. A pair or a plurality of roller bearings 88 mounted in the base of support plate 84 permit slidable movement of the plate in upper and lower slotted tracks 116 and 118 of flanges 90 and 92 of drive casing 50 as shown in FIG. 3.

FIGS. 6A and 6B show bearing support plate 56 for the driven or idle side of the rolls. Wedge plate 120 has legs 122 and 124 forming a v-shape wedge facing upwardly on support plate 56. A pair of roller bearings 54 is mounted in the base of plate 56 for riding in frame rail 54 of frame casing 50 as shown in FIG. 2. FIGS. 7A and 7D show an enlarged view of one of the wedges 16. As previously described each wedge 16 has sloping side surfaces 18 and 20 with a bearing 32 in the form of a steel ball mounted in each side. An upper portion 126 of the wedge has reduced cross section with a pair of steel ball bearings 128 mounted on a top surface. A pair of steel ball bearings 130 and 132 mounted on each side of upper portion 126. The upper portion 126 of wedge 16 is adapted to ride in a slotted track 134 (FIGS. 7C and 7D) of elongated bar 14. Slotted track 134 has rounded grooves 136 for receiving the steel ball bearings of wedge 16. A camshaft 138 and cam bearing 140 are mounted in bar 14 for selectively causing upward and downward movement of the bar when shaft 138 and cam bearing 140 are rotated.

In operation, the pressure on pressure lever 40 is relieved to permit adjustment of the roll spacing. Computer assisted hydraulic cams 46 are then actuated by lever arm 48 to raise or lower bar 14 causing wedges 16 to selectively further engage or partially disengage wedge plates 26 to adjust the spacing of the rolls. The pressure on pressure lever 40 is then reapplied to retain proper roll spacing during operation of the roller screen.

INDUSTRIAL APPLICABILITY

The present invention is particularly applicable to roller screens used to classify ore pellets or particulates.

I claim:

1. A roller screen apparatus, comprising: a frame, a plurality of rolls rotatably mounted in said frame, and an assembly for adjusting the spacing between the rolls, said assembly including an elongated bar mounted so as to extend lengthwise along the screen adjacent one end of said rolls, a plurality of v-shape wedges slidably mounted on said bar along a longitudinal direction thereof, a plurality of roll bearing support means slidably mounted in said frame and each having a v-shape wedge slidably engaging adjacent side surfaces of the wedges on said bar, and means for selectively causing translational movement of said bar upwardly and downwardly to adjust the spacing between the rolls by coaction of the wedges on the bar and said bearing support means.

2. The roller screen of claim 1 wherein said assembly for adjusting the spacing between the rolls comprises an assembly mounted adjacent each of the opposite ends of said rolls.

3. The roller screen of claim 1 wherein said means for causing translational movement of said bar comprises at least one rotatable cam.

4. The roller screen of claim 3 wherein said rotatable cam is hydraulically actuated.

5. The roller screen of claim 1 wherein said means for causing translational movement of said bar comprises a plurality of computer assisted hydraulically actuated rotatable cams.

6. The roller screen of claim 1 wherein said bearing support means comprises a plate having at least one bearing on a bottom edge thereof for riding in a track of said frame.

7. The roller screen of claim 1 wherein said bearing support means comprises a pair of plates, a first plate adapted for mounting on an exterior surface of said frame and being slidably mounted with respect to said frame, said first plate having said v-shape wedge portion thereon, a second plate adapted for mounting on an interior surface of said frame opposite the first plate, means for connecting the plates together, and a bearing journalling one end of a roll in said screen attached to one of said plates.

8. The roller screen of claim 7 wherein said bearing is attached to the second of said plates and said second plate has at least one bearing on a bottom edge thereof for riding in a track of said frame.

9. The roller screen of claim 8 further comprising a plurality of fasteners joining the plates together and a spring mounted on each fastener for resiliently pressing the plates together.

10. The roller screen of claim 1 further comprising a fixed stop mounted adjacent one end of said bar, a mobile stop slidably mounted adjacent the opposite end of said bar, and means for applying positive set pressure against said mobile stop sufficient to retain proper spacing between the rolls.

11. The roller screen of claim 10 wherein said means for applying pressure includes a lever rotatably mounted on said bar adjacent the mobile stop and having an arm bearing against said stop.

12. The roller screen of claim 11 further comprising computer assisted hydraulic means for maintaining proper pressure on said lever and against the mobile stop.

* * * * *